US005141175A

United States Patent [19]

Harris

[11] Patent Number: 5,141,175

[45] Date of Patent: Aug. 25, 1992

[54] AIR LAUNCHED MUNITION RANGE EXTENSION SYSTEM AND METHOD

[76] Inventor: Gordon L. Harris, 15719 Via De Santa Fe, Rancho Santa Fe, Calif. 92067-4751

[21] Appl. No.: 673,658

[22] Filed: Mar. 22, 1991

[51] Int. Cl.[5] ..... F42B 10/14; F42B 10/38

[52] U.S. Cl. ..... 244/3.25; 102/384; 102/490; 244/3.28

[58] Field of Search ..... 102/293, 384, 490; 244/3.1, 3.25, 3.28

[56] References Cited

U.S. PATENT DOCUMENTS

| | | | |
|---|---|---|---|
| 2,399,215 | 4/1946 | Fahrney | 102/384 |
| 2,423,090 | 7/1947 | Fink et al. | 102/384 |
| 2,973,164 | 2/1961 | Grill | 244/3.25 |
| 2,992,794 | 7/1961 | Boyd | 244/3.25 |
| 3,088,403 | 5/1963 | Bartling et al. | 102/399 |
| 3,613,617 | 10/1971 | Hamilton | 244/3.25 |
| 4,228,737 | 10/1980 | Kahn et al. | 102/384 |
| 4,296,894 | 10/1981 | Schnabele et al. | 244/3.1 |
| 4,447,025 | 5/1984 | Bock et al. | 244/3.28 |
| 4,896,845 | 1/1990 | Peretti et al. | 244/3.1 |

*Primary Examiner*—Charles T. Jordan
*Attorney, Agent, or Firm*—Edward A. Sokolski

[57] ABSTRACT

A device having pop-out wings and a guidance and control system is detachably mounted on a munition such as a bomb and is used to extend the range capability of the munition. Prior to launch, the wings are folded together. The control system is contained within a saddle portion of the device, and when the munition is released from the aircraft, the wings are caused to pop out to their flying position. The saddle is secured to the munition through a single bolt. Controllable flaps are installed along the trailing edges of the wings, such flaps being operated to control the pitch and roll angle of the munition. When the target area is reached, the device is jettisoned by detonating a charge which shears the securing bolt, thereby permitting the device to pivot rearwardly and separate from the munition.

3 Claims, 5 Drawing Sheets

AIR LAUNCHED MUNITION RANGE EXTENSION SYSTEM AND METHOD

BACKGROUND OF THE INVENTION

1. Field of the Invention

This invention relates to air launched munitions such as bombs and more particularly to an aerodynamic wing device which is detachably connected to such a munition for controlling and extending the range thereof.

2. Description of the Related Art

Highly effective unguided and guided munitions such as, for example, cluster bombs, laser, infra-red, and television guided "smart" missiles which are launched from manned aircraft are in the weapons inventories of many nations. However, since the range of such munitions is limited, it is necessary that the launching aircraft come very close to the target. This presents high exposure of such aircraft to surface-to-air missiles and guns. To reduce this risk, it is therefore highly desirable to increase the stand-off range of the munition so that such munition can be launched a greater distance from the target. Several attempts have been made in the prior art to overcome this problem. Other systems have been developed to extend the range of certain types of munitions and to provide guidance and control.

The PAVEWAY family of smart bombs is a widely known example. In this case, standard 500, 1000, or 2000 pound bombs are fitted with a nose kit (housing a laser seeker and actuated canards) and a tail kit having after-launch deployable "wing" surfaces. This kit extends the range of the bomb and provides terminal guidance.

The GBU-15 is another example of a kit which adds a nose seeker section (in this case, a TV camera seeker) and a tail mounted wing and control surface assembly to provide range extension and guidance to an otherwise short range "dumb" bomb.

Other similar examples such as the French MATRA and Israeli OPHER bomb kits also exist. However, no known system uses the method of the present invention for achieving pitch control through the generation of downwash at the existing munition tail surfaces.

Munitions systems which employ attached wing structures which are folded prior to launch and unfolded after launch and subsequently released from the munition when the target is reached are described in U.S. Pat. No. 4,447,025 issued May 8, 1984 to Bock, et al. and U.S. Pat. No. 4,296,894 issued Oct. 27, 1981 to Schnabele et al.

BRIEF SUMMARY OF THE INVENTION

The device of the present invention overcomes the aforementioned shortcoming of prior art munitions by extending the stand-off range of munitions a sufficient distance so that such munitions can be launched from aircraft at a location where such aircraft have substantially less vulnerability to attack. This end result is achieved by means of a range extension device which can be attached to the munition by a simple retrofit.

The device of the invention comprises a central main body "saddle" structure in which control and sensing elements are mounted. Mounted on the saddle are a pair of pop-out wings which are folded together prior to launch but which are extended to their flying positions once the munition is launched. On the trailing edge of each wing, a flap or aileron is pivotally mounted. These control surfaces can be selectively deflected to control the roll angle of the munition in the same basic manner in which an aircraft is controlled by means of its ailerons. More significant to the present invention is longitudinal control which is provided to generate a pitching and lift by a collection deflection of the control surfaces which modulates the air flow over the munition's existing tail surfaces. This results in an increased angle of attack and an accompanying increase in lift.

The saddle of the range extension device is pivotally supported along its rear edge on a hardback fitting which is bolted to the munition. Towards the forward end thereof, the saddle is attached to the body of the missile by means of a frangible bolt member which contains an explosive charge. When the munition reaches the vicinity of the target, the explosive charge is activated by a suitable control permitting the saddle to pivot rearwardly and release from the munition so as to cleanly jettison the range extension device without interference with the travel of the munition

DETAILED DESCRIPTION OF THE INVENTION

Figure 7:
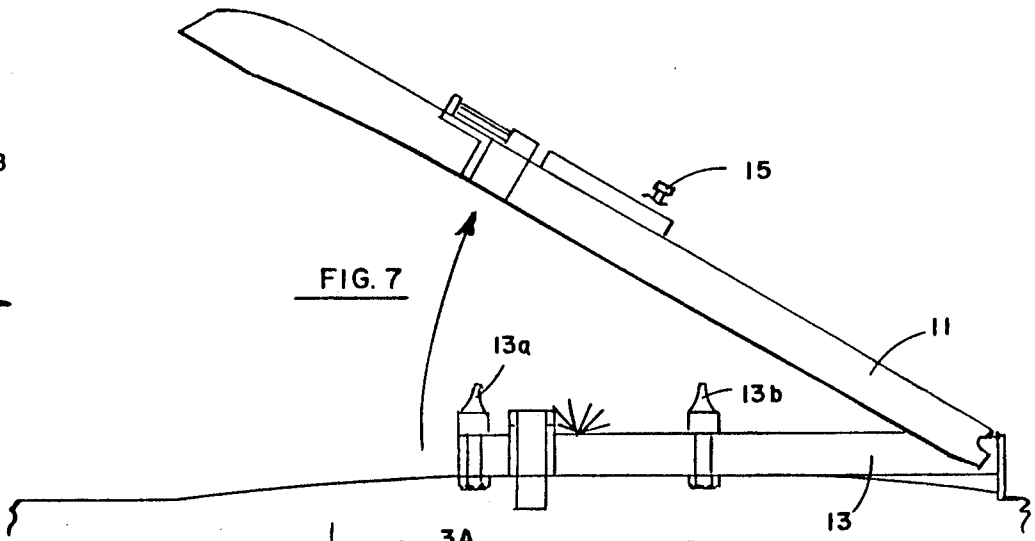
FIG. 7 is a schematic illustration showing the release of the device of the invention when in the vicinity of the target.

Referring now to FIGS. 1–4, a preferred embodiment of the invention is shown. Saddle member 11 forms the main body of the device of the invention, this saddle member having a compartment 12 formed therein(see FIG. 3A) in which the circuitry and servo control mechanisms for controlling the device of the invention are mounted. The underside of saddle member 11 is contoured to matingly fit onto the top surface of munition 14, the saddle member being detachably mounted on this surface by means of explosive bolt 15. Saddle member 11 has a pair of apertures **11*a* and 11*b* formed therein through which lugs 13*a* and 13*b* of hardback member 13 fit. Hardback member 13 which is contoured to mate with the surface of the munition 14 is fixedly attached thereto by means of bolts(not shown). The tail portion 11*c* of the saddle member has a slot formed therein which is pivotally connected to pivot shaft 13*c* of the hardback member, the central portion of the tail portion being indented so that it fits over the hardback member The wing saddle 11 is jettisoned from the munition 14 once the initial approach point to the target is reached by detonation of explosive bolt 15 as illustrated in FIG. 7. Suitable such explosive bolts are commercially available and can be obtained among other sources from Holex, a division of Whittaker Corporation (Holex part no. 10593-1). After the detonation of bolt 15, the lift on the wings of saddle 11 causes the saddle to be rotated rearwardly about pivot shaft 13***c* and separate from the munition insuring that the wings do not strike the tail surfaces of the munition before separating. Once the saddle is shed, all that is left on the munition is hardback 13 which is small and light enough not to affect the terminal trajectory of the munition.

Figure 3A:
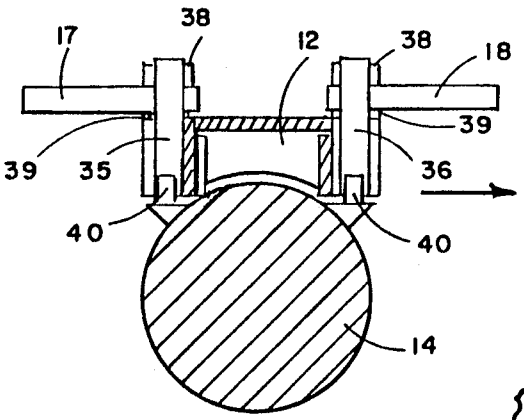
FIG. 3A is a cross sectional view taken along the plane indicated by 3A—3A in FIG. 3.

As shown in FIG. 3A, the wings 17 and 18 are clamped to rotatably mounted shafts 35 and 36 respectively by means of nuts 38 which clamp the wings against shoulders 39 which are machined into the shafts. Threaded keepers 40 are screwed into the shafts to maintain load on the thrust bearings supporting the shafts to eliminate play.

Figure 1:
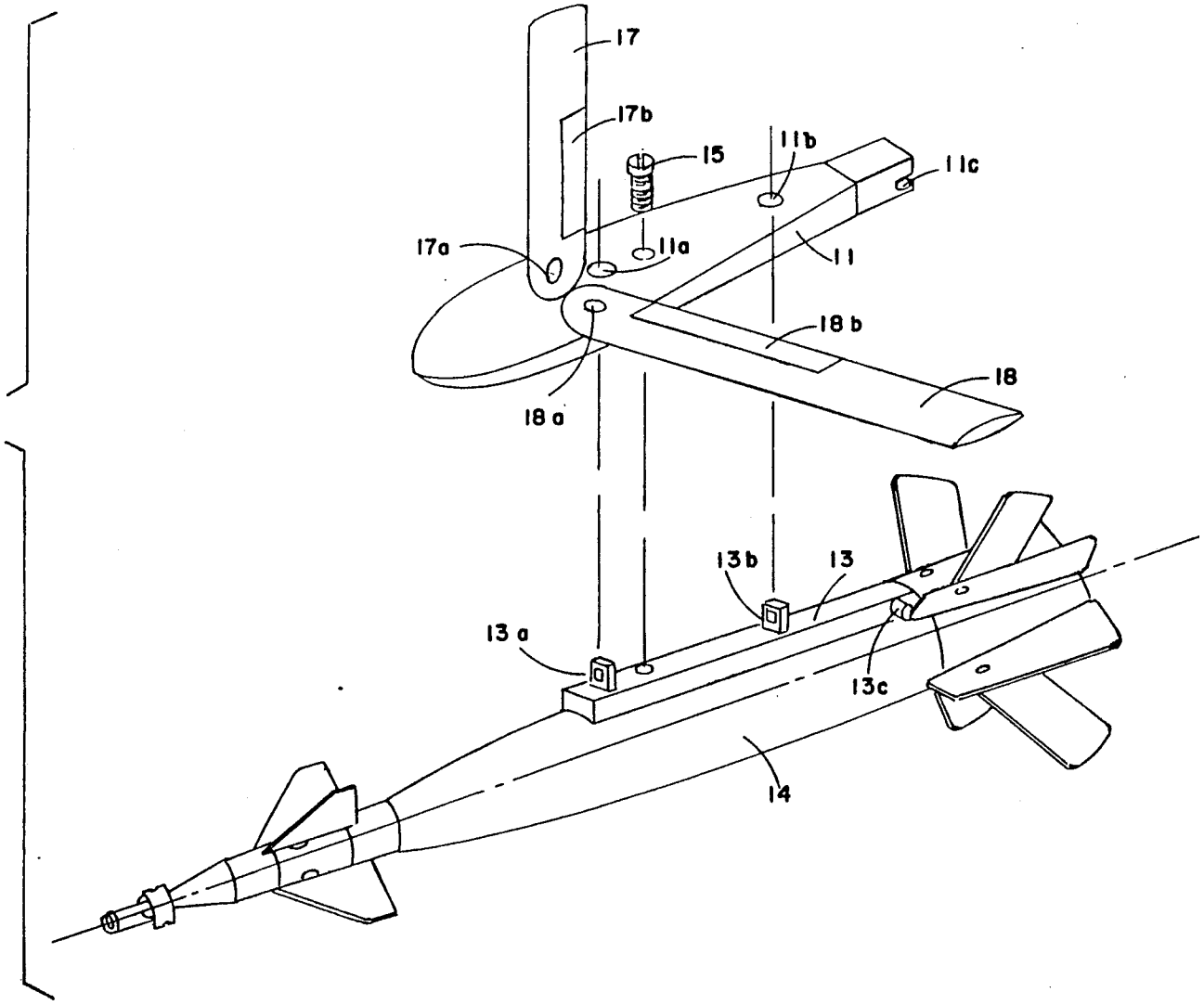
FIG. 1 Is an exploded perspective view of a preferred embodiment of the invention showing how it is attached to a munition.
Figure 2:
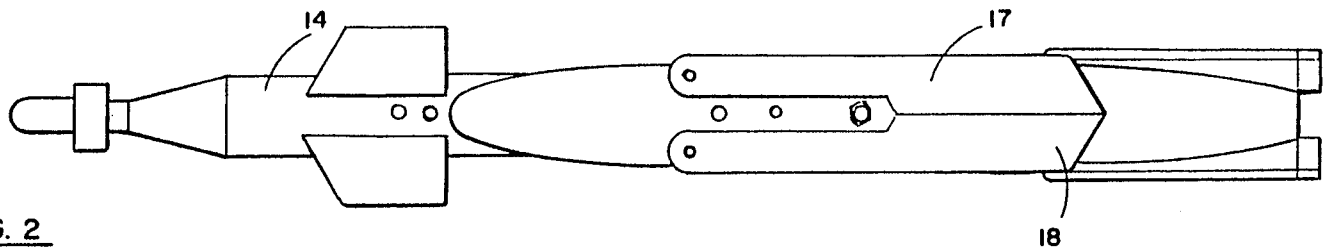
FIG. 2 is a top plan view of the preferred embodiment as attached to a munition prior to launch.
Figure 3:
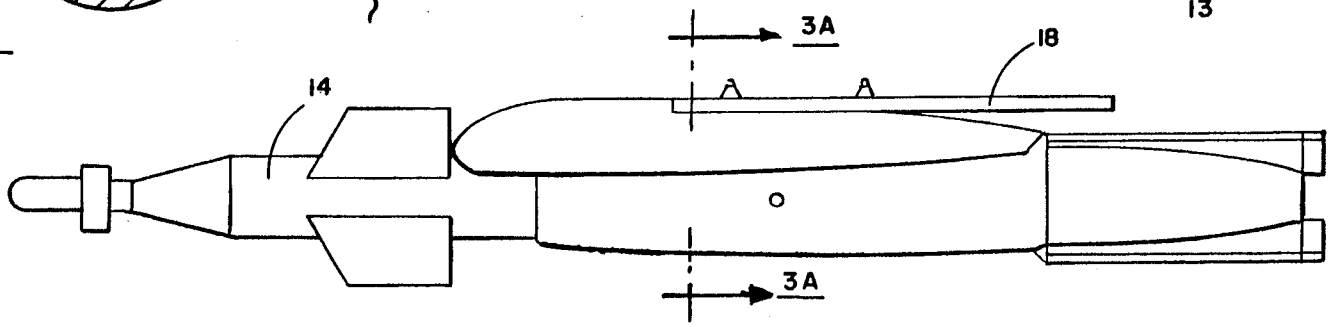
FIG. 3 is a side elevational view of the preferred embodiment as attached to a munition prior to launch.
Figure 4:
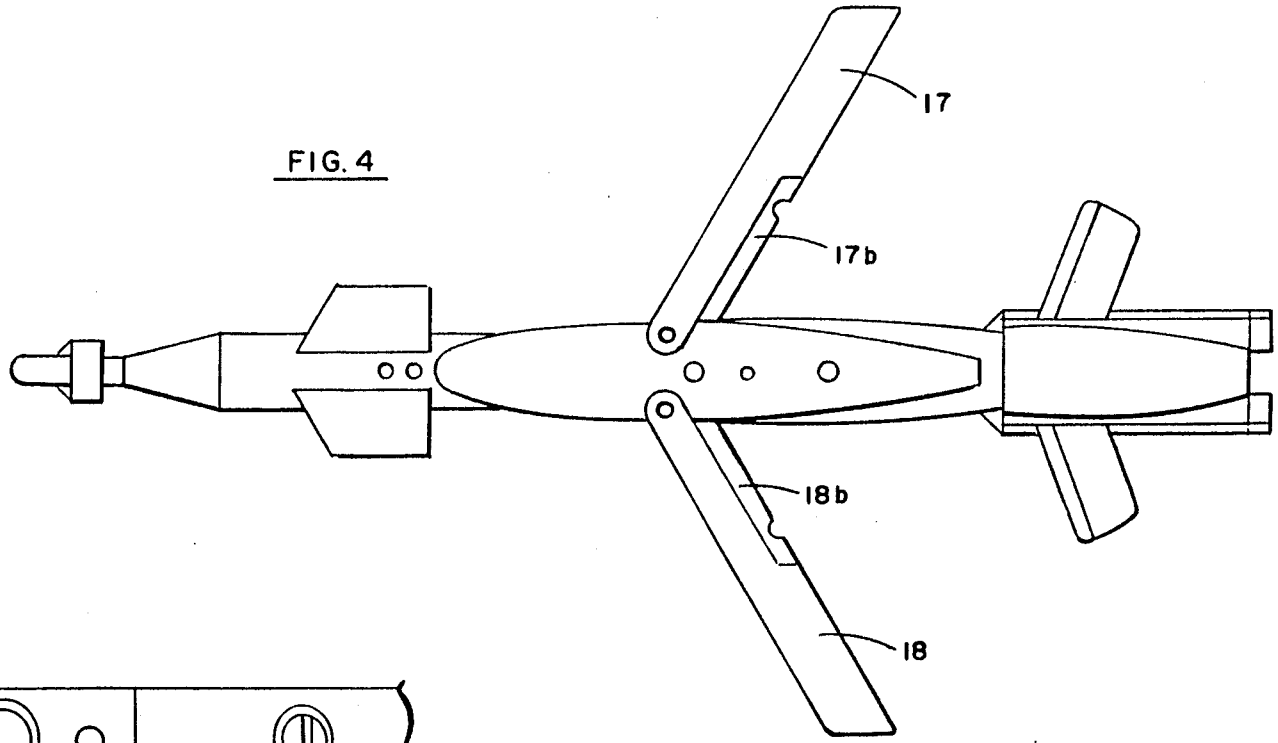
FIG 4 is a top plan view of the preferred embodiment as attached to a munition subsequent to launch.
Figure 5A:
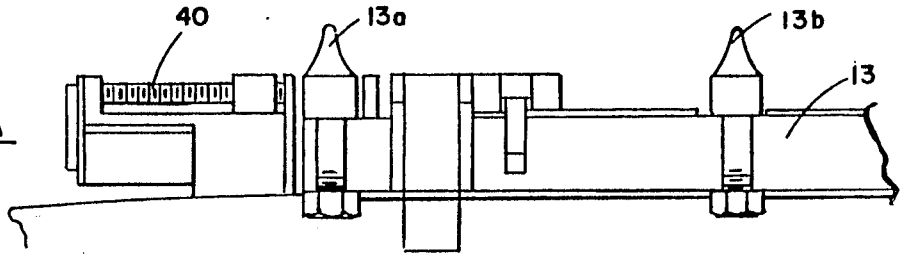
FIG. 5A is a side elevational view of the wing actuation mechanism shown in FIG. 5.
Figure 5:
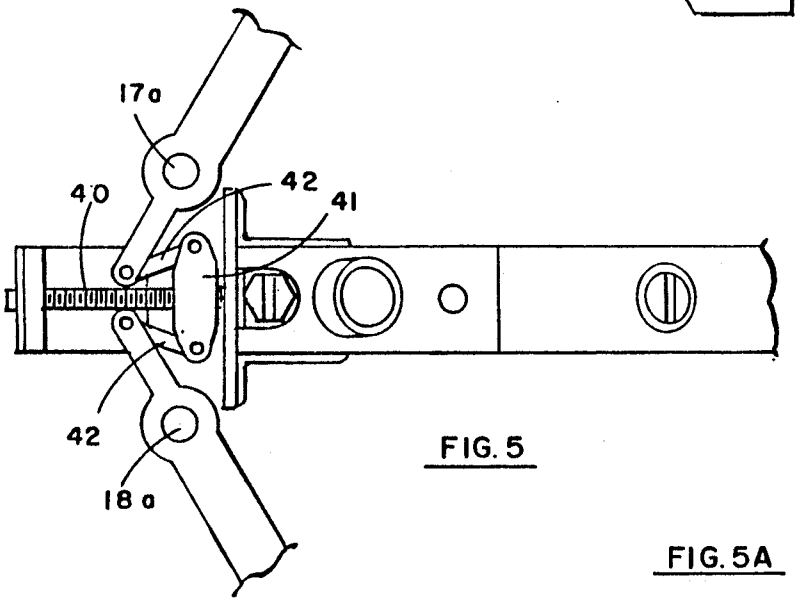
FIG. 5 is a top plan view illustrating the wing actuation mechanism of the preferred embodiment.

Wings 17 and 18 are mounted on saddle 11 for pivotal motion about axes 17*a* and 18*a* respectively. Prior to launching of the munition, the wings are held in a folded position, as shown in FIGS. 2 and 3. When the munition is launched, the wings pop out to the extended position shown in FIGS. 1 and 4. The wings are driven to their extended position, as shown in FIGS. 5 and 5A by means of lead screw 40 which is driven by a motor (not shown). The lead screw threadably engages and drives drive puck 41 which in turn drives arms 42 which are pivotally connected to the wings. A microswitch (not shown) is used to sense the fully extended position of the wings and turns the motor off. A spring actuated mechanism could also be used to accomplish this function.

Each of wings 17 and 18 has a respective control surface 17*b*, 18*b* pivotally mounted along the trailing edge thereof. These control surfaces operate aerodynamically as ailerons or flaps in controlling roll of the munition as well as the pitch angle or angle of attack thereof, such control being achieved by means of a servo control device, as to be explained further on in the specification.

Figure 6:
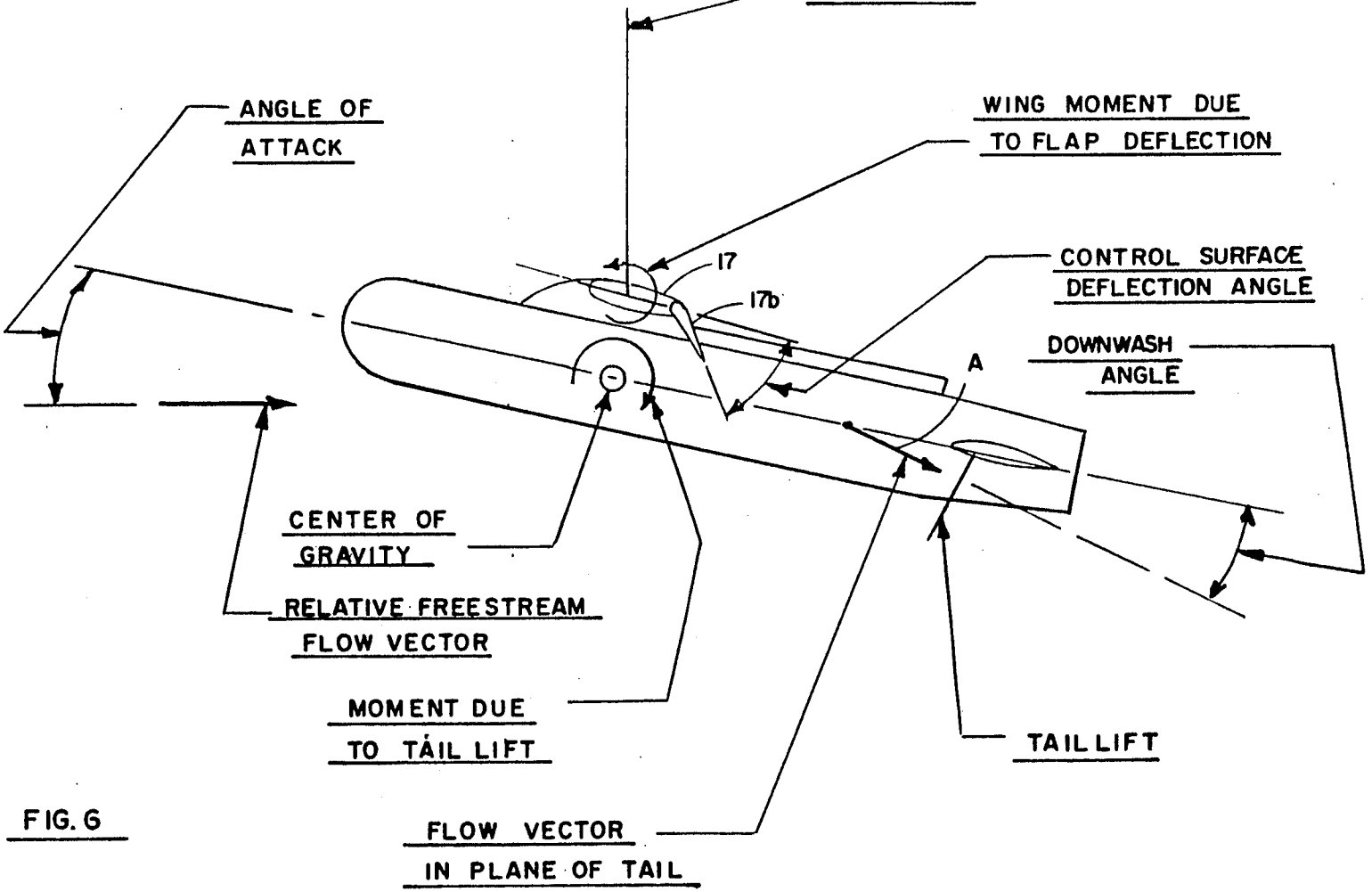
FIG. 6 is a schematic side elevational view of the preferred embodiment illustrating the operation of the control surfaces thereof.
Figure 8:
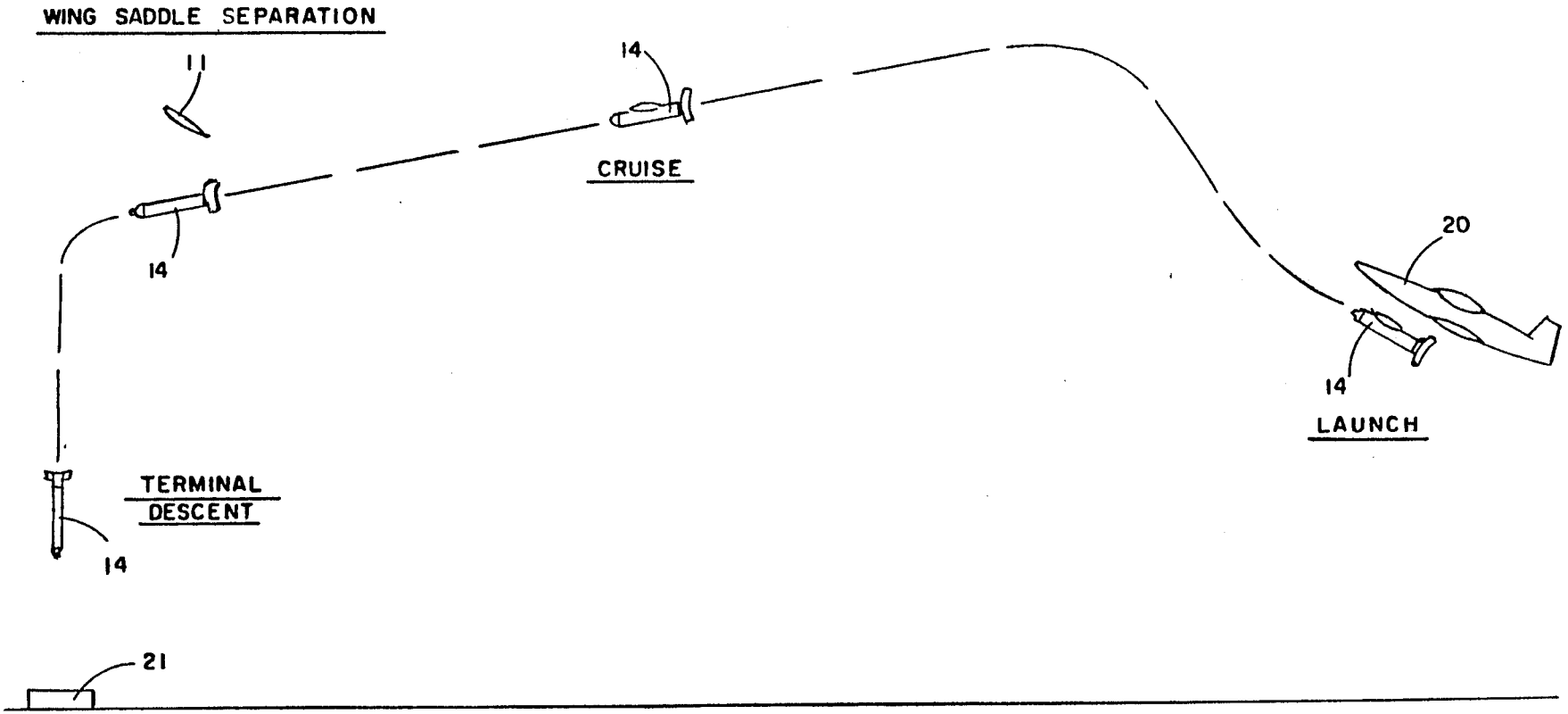
FIG. 8 is a schematic illustration showing the basic features of the operation of the system of the invention.

Referring now additionally to FIGS. 6–8, the operation of the device of the invention will now be described, FIG. 8, schematically illustrating the travel of the munition from launch aircraft 20 to target 21. Immediately after the munition 14 is launched, wings 17 and 18 pop out to the extended positions shown in FIG. 4, in response to appropriate control signals. Control surfaces 17*b* and 18*b* are actuated to provide the desired roll and longitudinal stability for the munition by means of a servo control system which responds to data in accordance with rate, heading, and attitude of the munition sensed by sensors installed in the saddle. Such roll control is achieved by differential deflection of the control surfaces, in the same general manner as in a conventional aircraft. However, longitudinal control to enhance the range of the munition is also achieved with the control surfaces in a manner which is believed to be unique.

Referring now to FIG. 6, such longitudinal control will now be described. In achieving such longitudinal control the control surfaces 17*b* and 18*b* are collectively deflected, i.e. in the same direction. As shown in the Figure, such deflection of the control surfaces is with both flaps having their trailing edges down. This causes three things to occur. Firstly, the lift of the wing increases through the change in geometric camber resulting from such deflection. Moreover, since the wing is swept, and the control surfaces are mounted on the inboard part of the span, this additional lift gives rise to a nose-up pitching moment, which tends to increase the angle of attack, resulting in still more lift. Secondly, such deflection results in aft loading of the wing section and an accompanying nose-down wing section pitching movement which tends to decrease the angle of attack of the munition which would normally result in a loss of lift. However, the flap deflection also generates a powerful downwash at the fixed tail surfaces of the munition, as indicated by arrow A. This results in a downward force on these surfaces which tends to increase the angle of attack of the munition. This nose up downwash effect on pitching moment more than compensates for the nose down pitching moment caused by the aft loading of the airfoil due to flap deflection, resulting in a net increase in angle of attack and hence an additional increase in lift. Similarly, deflection of the control surfaces so that their trailing edges are up, produces a reduction in angle of attack and lift. In this manner complete control of the pitch of the munition during its flight is achieved.

A typical flight profile of a munition employing the device of the invention is shown in FIG. 8. Immediately after launch, the flaps are deflected downwardly to increase angle of attack and lift thereby causing the munition to climb to a higher altitude. Once, the munition reaches the maximum altitude, it is controlled to glide to the vicinity of the target. When the target area is reached, the range extension device of the invention is jettisoned and the munition descends to the target. Such jettisoning is achieved as shown in FIG. 7, as has been previously described.

Various control systems which are well known in the art can be utilized for controlling the operation of the device of the invention. One such system is that designed for the PAVEWAY-type laser seeking weapon. The various sensors and the computer for this system is packaged in the wing saddle compartment 12. The sensor complement includes a two-axis free gyro, commercially available from Humpreys Instruments Co.(model no. FG65-4001-3) which measures yaw and roll angles relative to the launch values; a pitch rate gyro; and static and dynamic pressure transducers for airspeed and barometric altitude determination. A digital computer is employed to translate this data into pitch and roll commands to servo actuators mounted in the wings. Such control systems are well known to those skilled in the art.

In operating the system, the launch aircraft initiates the munition flight computer with target range data. The heading to be flown is determined by the launch aircraft's heading (sample and hold) as the pilot maintains zero target line-of-sight rate at the time of launch. Heading and altitude integrators are included to eliminate stand-off errors that would seriously affect accuracy. The control system is designed to maintain the initial launch attitude (pitch angle), as computed from the air data until apogee. At that time, the remaining distance to the target and the altitude profile is automatically tailored to bring the round to the initial approach point (iap) altitude, that will allow the munition to engage the target once the wing kit is jettisoned. In certain missions it may be necessary to incorporate a Global Positioning System (GPS) receiver with a magnetometer to improve accuracy on longer range missions in which case the munition would receive launch and target GPS fixes.

When the airborne computer determines that the munition has reached the initial approach point (iap), the wing is jettisoned as already described. In the case of the PAVEWAY munition, the action of the saddle separation pulls a lanyard which activates a thermal battery which in turn allows the munition to guide onto its target. Up until this point the PAVEWAY guidance system would be completely dormant.

The system of the invention thus provides means for effectively extending the range of existing munitions by a simple retrofit thereto.

While the invention has been described and illustrated in detail, it is to be clearly understood that this is intended by way of illustration and example only and is not to be taken by way of limitation, the scope of the invention being limited only by the terms of the following claims.

I claim:

1. A device for extending the range of an air launched munition having tail surfaces comprising:

a saddle member, pivotal mounting means for detachably pivotally supporting the rear end of said saddle member on said munition, a pair of wing members mounted on said saddle member for movement from a folded stored position to an extended flying position, means for driving said wing members from the folded position to the flying position after said munition is launched, control means for actuating said driving means, deflectable flaps supported for pivotal motion on the trailing edges of said wing members, control means for controlling said flaps to selectively effect rolling or pitching movement of said munition, and means for detaching said device from said munition such that said saddle member rotates rearwardly on said pivotal mounting means when the target area is reached thereby effecting the jettisoning of said device.

2. A device for extending the range of an air launched munition having tail surfaces comprising:

a saddle member, means for detachably mounting said saddle member on said munition, a pair of wing members mounted on said saddle member for movement from a folded stored position to an extended flying position, means for driving said wing members from the folded position to the flying position after said munition is launched, control means for actuating said driving means, said saddle member including a compartment for containing said control means, the under surface of said saddle member being contoured to matingly engage the upper surface of said munition, deflectable flaps supported for pivotal motion on the trailing edges of said wing members, control means for controlling said flaps to selectively effect rolling or pitching movement of said munition, and means for detaching said device from said munition when the target area is reached thereby effecting the jettisoning of said device.

3. A device for extending the range of an air launched munition having tail surfaces comprising:

a saddle member, means for detachably mounting said saddle member on said munition comprising a hard back assembly fixedly attached to the munition, said hard back assembly having a pair of studs extending therefrom, a pair of apertures being formed in said saddle member, said studs being fitted through said apertures, means for pivotally connecting the rear end of said saddle member to said hard back assembly, and explosive bolt means for retaining the forward end of said saddle member to said munition, a pair of wing members mounted on said saddle member for movement from a folded stored position to an extended flying position, means for driving said wing members from the folded position to the flying position after said munition is launched, control means for actuating said driving means, deflectable flaps supported for pivotal motion on the trailing edges of said wing members, control means for controlling said flaps to selectively effect rolling or pitching movement of said munition, and means for detaching said device from said munition when the target area is reached comprising means for detonating said explosive bolt means, thereby releasing said saddle member to effect the jettisoning of said device.

* * * * *